US011305329B2

(12) United States Patent
Janikowski et al.

(10) Patent No.: US 11,305,329 B2
(45) Date of Patent: Apr. 19, 2022

(54) TUBING WITH HYDROPHOBIC SURFACE

(71) Applicant: Plymouth Tube Co., Warrenville, IL (US)

(72) Inventors: Daniel S. Janikowski, Warrenville, IL (US); Charles Murphy, West Monroe, LA (US); Christian Lange, Warrenville, IL (US)

(73) Assignee: Plymouth Tube Co., Warrenville, IL (US)

( * ) Notice: Subject to any disclaimer, the term of this patent is extended or adjusted under 35 U.S.C. 154(b) by 246 days.

(21) Appl. No.: 16/684,383

(22) Filed: Nov. 14, 2019

(65) Prior Publication Data

US 2020/0147669 A1 May 14, 2020

Related U.S. Application Data

(60) Provisional application No. 62/872,833, filed on Jul. 11, 2019, provisional application No. 62/767,108, filed on Nov. 14, 2018.

(51) Int. Cl.
*B21D 53/06* (2006.01)
*F28F 1/00* (2006.01)

(52) U.S. Cl.
CPC ..... *B21D 53/06* (2013.01); *F28F 1/00* (2013.01)

(58) Field of Classification Search
CPC .. B21D 53/06; B21D 53/02; F28F 1/00; F28F 2245/04; F28F 13/185; F28F 21/083; F28F 21/086; B21H 8/005; B21C 37/0818
See application file for complete search history.

(56) References Cited

U.S. PATENT DOCUMENTS

| | | | | |
|---|---|---|---|---|
| 7,927,707 | B2 * | 4/2011 | Kawasaki | F28F 13/18 428/457 |
| 9,303,322 | B2 * | 4/2016 | Victor | C25D 5/623 |
| 10,151,497 | B2 * | 12/2018 | Swindon | F28D 9/0025 |
| 2011/0247794 | A1 * | 10/2011 | Arment | F28F 1/02 165/181 |
| 2011/0252799 | A1 * | 10/2011 | Berndt | F28F 13/04 60/645 |
| 2011/0287203 | A1 * | 11/2011 | Victor | B29C 59/02 428/36.9 |

* cited by examiner

*Primary Examiner* — Ryan J. Walters
(74) *Attorney, Agent, or Firm* — Wood, Phillips, Katz, Clark & Mortimer

(57) ABSTRACT

A method of forming a heat exchanger tube, particularly suited for condensing applications, contemplates cold-rolling a metallic strip to emboss a hydrophobic surface texture, to thereby form an embossed surface on the metallic strip. The method includes roll forming the metallic strip to a tubular shape, with the embossed surface on the exterior of the tubular shape, and welding the edges of the roll-formed strip to form a heat exchanger tube. Cold-rolling to emboss a hydrophobic surface texture exhibiting a contact angle of at least about 75° is contemplated, with processing including heat-treatment to minimize degradation of the hydrophobic surface texture, and roll-forming to avoid deformation of the hydrophobic surface texture,

18 Claims, 11 Drawing Sheets

Fig. 1 Illustration of contact angles formed by sessile liquid drops on a smooth homogeneous solid surface (Yuan and Lee, 2013).

TUBING WITH HYDROPHOBIC SURFACE

CROSS-REFERENCE TO RELATED APPLICATIONS

This application claims the benefit of the filing date of U.S. Provisional Ser. No. 62/872,833, filed Jul. 11, 2019, and U.S. Provisional Ser. No. 62/767,108, filed Nov. 14, 2018, which are hereby incorporated by reference in their entirety.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates generally to steel tubing used in heat-exchanger applications, and more particularly to a method of forming steel tubing having an embossed, hydrophobic outer surface to provide enhanced heat exchanger performance.

BACKGROUND OF THE INVENTION

In a typical heat-exchanger arrangement, such as used in a steam condenser in a power plant, or similar application, condensation of processed steam is typically effected by directing the steam through banks of steel tubing, through which a cooling medium is directed. The condensate is collected, typically by gravity, for recirculation in the steam-generating process.

Experience has shown that when attempting to convert a gas to a liquid, the heat transfer coefficient often becomes limited when the surface of the heat transfer boundary becomes covered with a film of liquid. This film becomes a thermal barrier, which decreases the effective heat transfer coefficient. When the film forms on the surface, the effect is referred to as hydrophilic, i.e., wetting of the surface. On heat exchangers made of metal, this is the dominant method of heat transfer. It has been recognized that modification of the surface to increase the tendency of the water to bead up, exhibiting so-called hydrophobic behavior, would greatly facilitate removal of liquid water. Beads of water allow the metal surface to become directly exposed to the steam or gas. This results in significant improvements in overall heat transfer.

The majority of condensing heat exchangers are of a "shell and tube" design. The fluids to be condensed are on the shell side, to allow the condensed fluid to fall off the tube into a collection area in the bottom of the exchanger. In such an application, the hydrophobic surface should be provided on the exterior of the tubing. In the shell and tube design, gravity assists with the liquid removal by inducing the liquid beads to roll off of the tubing.

Hydrophobicity is not a natural phenomenon on metals surfaces. One common technique of creating a hydrophobic surface is done by coating surfaces with materials, such as waxes, polymers, stearates, and acids, that have natural hydrophobic surface tendencies. A summary of dozens of different surface treatments is set forth in "Science and Engineering of Superhydrophobic Surfaces: Review of Corrosion Resistance, Chemical and Mechanical Stability" Arabian Journal of Chemistry, 2018, authored by Darband, G. B., Aliofkhazraei, M., Khorsand, S., Sokhanvar, S., Kaboli, A., hereby incorporated by reference in its entirety.

The advantages of a hydrophobic surface on a tube in a condensing application has been recognized for years. If the condensing fluid wets the surface of the tube the layer becomes an insulator that significantly lowers heat transfer. If this fluid forms a bead like rain on a freshly waxed car, more of the metal is exposed significantly improving overall heat transfer. Many attempts have been tried to take advantage of hydrophobic surfaces in the power industry. The steam surface condensers used to improve the efficiency of the turbines are some of the largest condensing heat exchangers in any industry. By converting surfaces to dropwise from film forming, the improvement in efficiency can result in a condenser of 50% of the original size.

The addition of oils and wax-like coatings have been attempted. The oils have been found to contaminate other components in the steam system such as the resin bead polishing system needed to maintain the steam in an "ultra-clean" state to protect the turbine and the carbon steel system. The wax-like coatings have been found to be initially effective, but within a few weeks the wax was removed, degrading the film-forming mechanism, resulting in degradation of the heat transfer.

Some plastic hydrophobic coatings have been considered. Although the plastic can be effective in applications like airplane wings to prevent icing, the supersonic nature of the steam in a steam surface condenser gradually erodes away the hydrophobic plastic. Many steam surface condensers which are in service have been in service as long 50 years, and now the Nuclear Regulatory Commission (NRC) is encouraging nuclear power plants to apply for licenses for up to 80 years.

Airplane wings can be recoated—large heat exchangers are a different case. The tubes in a condenser are tightly packed together, typically with only a ¼" space between them. Some of these plants may have as many as 90,000 tubes in the condenser. The close spacing and significant number of tubes with no access to the exterior surface makes it impossible to effectively recoat the tubing.

Unfortunately, experience has shown that these types of coatings are not sufficiently durable to the aggressive nature of high temperature, supersonic velocity steam, as is common in a power plant condenser. As a consequence, the service life of such coatings is quite short. As condensers are typically designed to ensure reliability for 30 to 50 years, it is uneconomical to repair or replace such coatings.

Converting the actual metal surface to exhibit hydrophobic characteristics enhances reliability. To this end, chemical etching, chemical growth, and anodic oxidation have produced hydrophobic surface characteristics on copper and aluminum alloys, but these alloys are known to have a surface degradation in power plant condensing service. See "Superhydrophobic Surfaces", pp. 14-14, 27-44; Elsevier 2015, authored by Crawford, R. J., Ivanova, E. P., hereby incorporated by reference in its entirety.

Chemical vapor deposition can be used to develop more robust coatings than the oils, waxes and plastic film described earlier. The processes are similar to the methods used to make electronic circuits. Since they have very high definition, they can be ideally tailored for a hydrophobic surface designed for specific fluids. However, the coatings need to be made in very special vacuum chambers. This makes it very difficult to do so on long length tubes that can be over 100 ft. If a chamber could be developed to do so. the slow speed of the method would be very expensive, exceeding 5 times the value of the tubing.

Other metallic, hydrophobic coatings have been developed by the use of a pulsed laser, and electrochemical, plasma, and chemical vapor deposition methods. However, use of these techniques requires ultra-clean surfaces, and the methods employed in these deposition processes are slow, and expensive. At this time, it is believed that these processes are not sufficiently economical as to be commercially viable in the relatively near future.

Textured tubing has been used in many industries for a number of years. Its primary use is to enhance surface area or to create turbulence. Both can be effective methods to improve heat transfer. Outside diameter (OD) finned tube is commonly used in applications where a liquid is on the tube inside diameter (ID) and a gas is on the tube OD. The finned extra surface on the OD can be either mechanically formed from the tube itself, or added on be welding, brazing, or mechanical attachment. If the ID fluid has low velocity or the viscosity is high, the ID fluid can form a significant boundary layer on the surface. This layer can be a significant barrier to conductivity. To improve heat transfer in this situation, the tube can be enhanced with ID spiral fins or by dimpling the tube. The ID fins or the dimples create turbulence which then minimizes the boundary layer.

None of these features help when OD condensing is desired. The OD fins or dimples can pool with the fluid or water which then lowers conductivity. It has been found that a microtexture on the OD surface can be much more effective. The special type of microtexture which works best is one that is hydrophobic. That is one that encourages the fluid to bead up and quickly roll off. Without this texture, the water tends to form a film insulating the metal surface.

The present invention contemplates a method of economically forming textured steel tubing suitable for use in heat-exchanger applications, wherein the surface texture of the tubing provides hydrophobic characteristics to enhance heat exchanger thermal performance.

SUMMARY OF THE INVENTION

In accordance with the present invention, a method of forming a heat exchanger tube is disclosed which facilitates economical formation of tubing exhibiting a hydrophobic exterior surface, which is particularly suitable for heat-exchanger applications such as for condensing process steam in power generation and like installations. Economical formation is facilitated by cold-rolling to form a hydrophobic surface texture, with subsequent formation of tubing by welding completing formation. Notably, tube formation is effected while minimizing deformation of the textured surface.

In accordance with the present invention, a method of forming a heat-exchanger tube comprises the steps of providing a metallic strip, typically steel, and cold-rolling the metallic strip to emboss a hydrophobic surface texture to thereby form an embossed surface on the metallic strip. The present method further contemplates roll-forming the metallic strip to a tubular shape, with the embossed surface of the metallic strip positioned on the exterior of the tubular shape. The process is completed by welding the edges of the roll-formed strip to form a heat-exchanger tube.

In order to enhance the hydrophobic surface characteristics of the tubing, the present method contemplates that the cold-rolling step embosses the hydrophobic surface texture to exhibit a liquid contact angle of at least about 75°, more preferably a least about 90°. Heat-treatment of the heat-exchanger tube is preferably effected to minimize degradation of the hydrophobic surface texture. Such heat treatment may comprise hydrogen annealing, or providing a gas blend that includes hydrogen.

Heat treatment may further include providing an inert gas in order to minimizes oxidation of the hydrophobic surface texture.

In accordance with the invention, heat treatment of the heat exchanger tubing may employ a specialized quick-quench system, employing forced gas flow. Such a quick quench system may comprise a relatively soft, conductive shoe for removal of heat.

Typically, the metallic strip from which the heat exchanger tubing is formed comprises stainless steel, but may further comprises titanium or a titanium alloy.

To facilitate roll-forming of the metallic strip, it is contemplated to provide forming rolls having sufficiently soft surfaces, to form the tubular shape without significant deformation of the hydrophobic surface texture. Such forming rolls may entirely comprise soft material, or have a sufficiently soft surface layer.

Thus, the present invention contemplates a system comprising a plurality of heat-exchanger tubes, wherein a liquid is circulated through an interior of each of said tubes, and a fluid that is condensed contacts an exterior of each of said tubes.

Other objects, features, and advantages of the present invention will become readily apparent from the following description, the accompanying drawings, and the appended claims.

DETAILED DESCRIPTION OF THE PREFERRED EMBODIMENT

Figure 1:
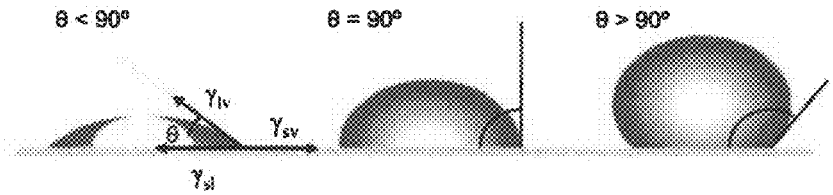
FIG. 1 is a diagrammatic illustration of contact angles formed by sessile liquid drops on a smooth homogeneous surface.

While the present invention is susceptible of embodiment in various forms, they are shown in the drawings and will hereinafter be described presently preferred embodiments, with the understanding that the present disclosure is to be considered as an exemplification of the invention, it is not intended to limit the invention to the specific embodiments illustrated.

The present invention contemplates a method of enhancing heat exchanger thermal performance by providing heat exchanger tubing with a textured, hydrophobic exterior surface. In distinction from previous techniques, including non-durable coatings, and relatively expensive metal deposition and the like, the present invention contemplates an economical method for formation of the desired hydrophobic surface, which will exhibit the necessary durability, while facilitating formation in a cost-effective manner. Notably, features of the present invention promote preservation of the textured, hydrophobic surface attendant to tube formation by avoiding deformation of features of the surface texture.

By way of background, the manner in which a hydrophobic surface promotes enhanced thermal conductivity is generally well-known. By way of example, FIG. 1 diagrammatically illustrates views of a water bead on a textured surface. If the contact angle is relatively low, as shown on the left end of FIG. 1, the surface is generally hydrophilic. As the contact angle becomes greater, as further shown in FIG. 1, the surface is known as hydrophobic. The hydrophobic surface is sometimes referred to as the "lotus effect", from the lotus leaf on which water beads up and runs off. See, 2013 "Contact Angle and Wetting Properties" Surface Science Technologies, Springer, pp 3-34, authored by Yuan, Y., Lee, T. R., hereby incorporated by reference in its entirety.

The hydrophobic surface texture is microscopic. Typically, when viewed with the unaided eye, the surface appears dull, and not shiny. It is believed that the critical factor for hydrophobic metal texturing is the "bump" spacing and size. It is believed that little depth is required, and believed that even more depth may perhaps be detrimental to creating hydrophobicity. Conceptually, the goal is to create spaces that are small enough that liquid water cannot penetrate them, with bumps that are very small so that wetting is difficult.

As noted, surface texturing which results in hydrophobicity is sometimes referred to as the "lotus effect". Notably, high magnification surface examination of natural surfaces, such as the lotus leaf, have shown the "bump" texture that produces the hydrophobic effect wherein the "bump" can be as fine as 1 micron in diameter and height, and and as great as 20 microns in diameter and height. Such patterns are visually unique, as have been observed in the lotus leaf, India canna leaf, tars leaf, and perfoliate knotwood leaf.

Figure 2:
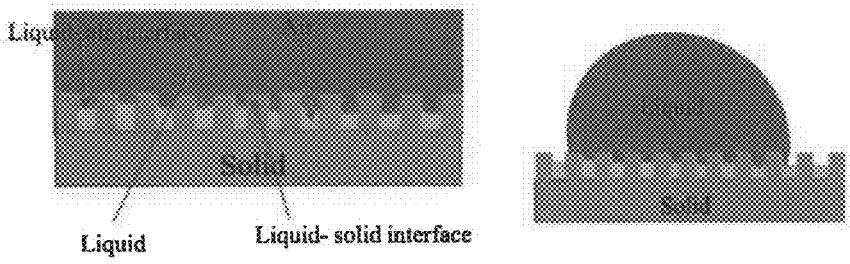
FIG. 2 shows schematic views of the trapped gas pocket between a textured surface beneath the water drop, and the resulting hydrophobic bead.
Figure 3A:
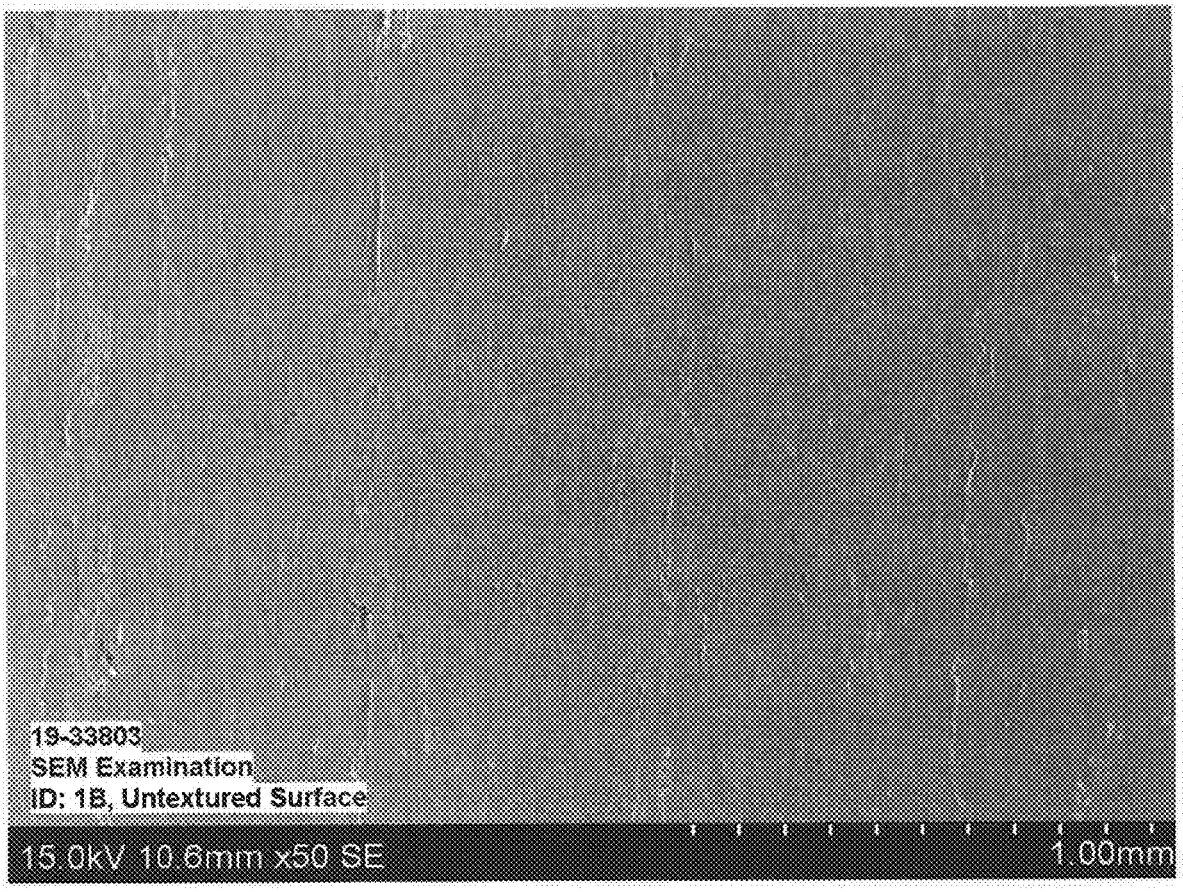
FIGS. 3A-3D are scanning electron microscope photomicrographs of an untextured, steel surface.
Figure 3B:
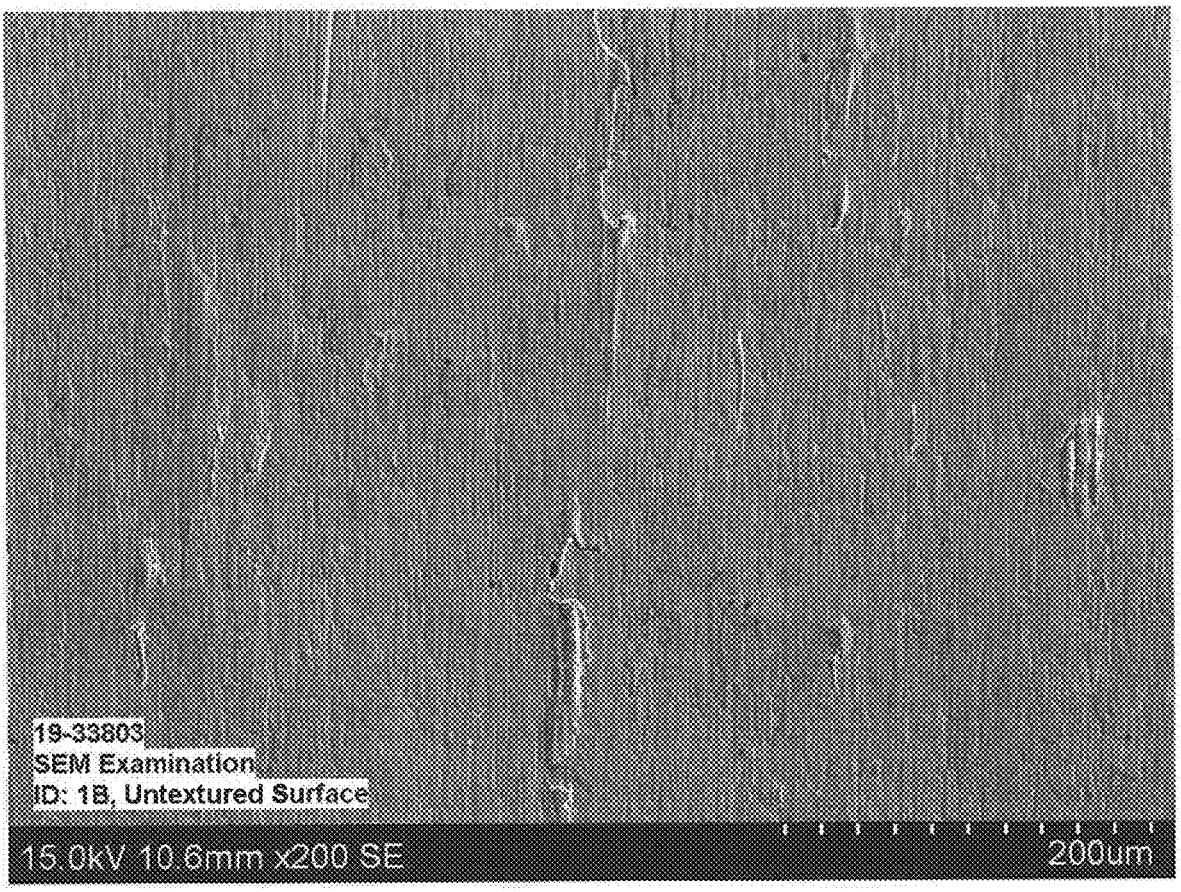
Figure 3C:
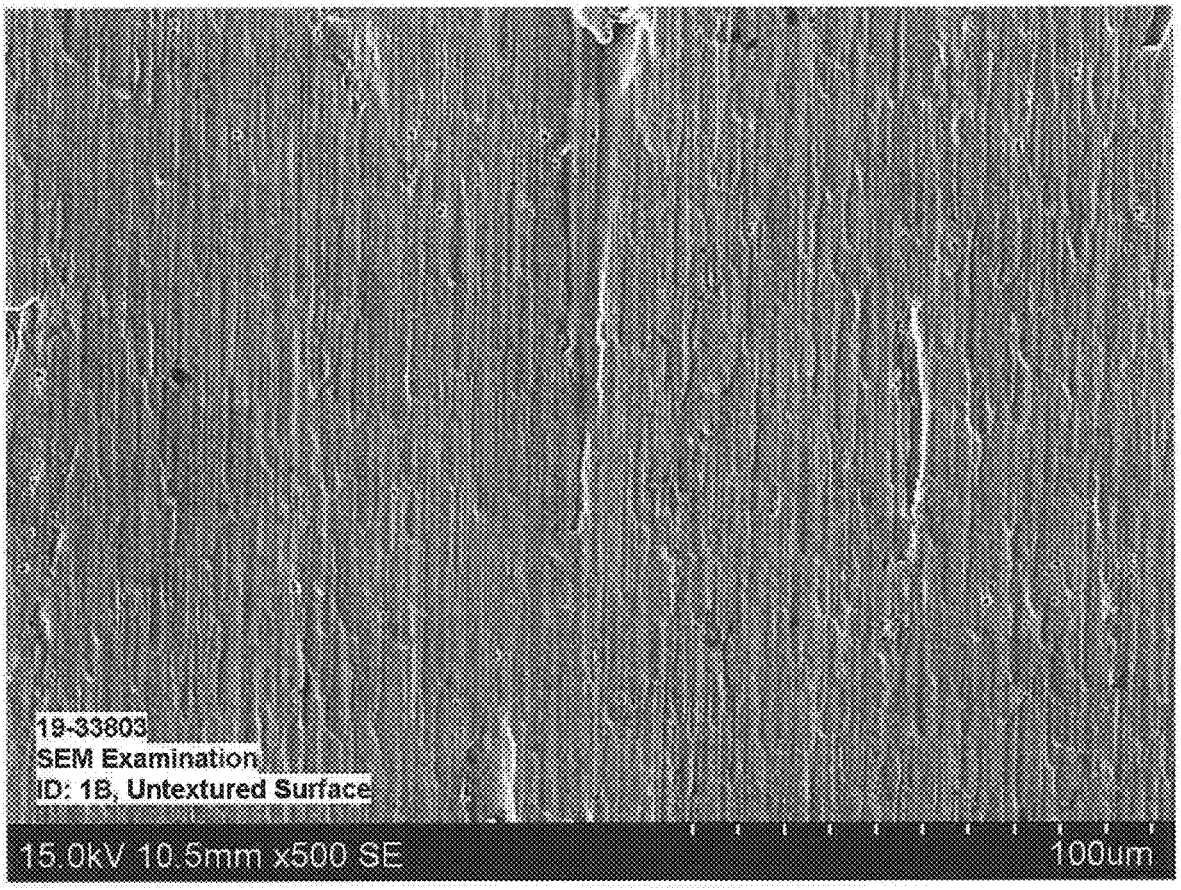
Figure 3D:
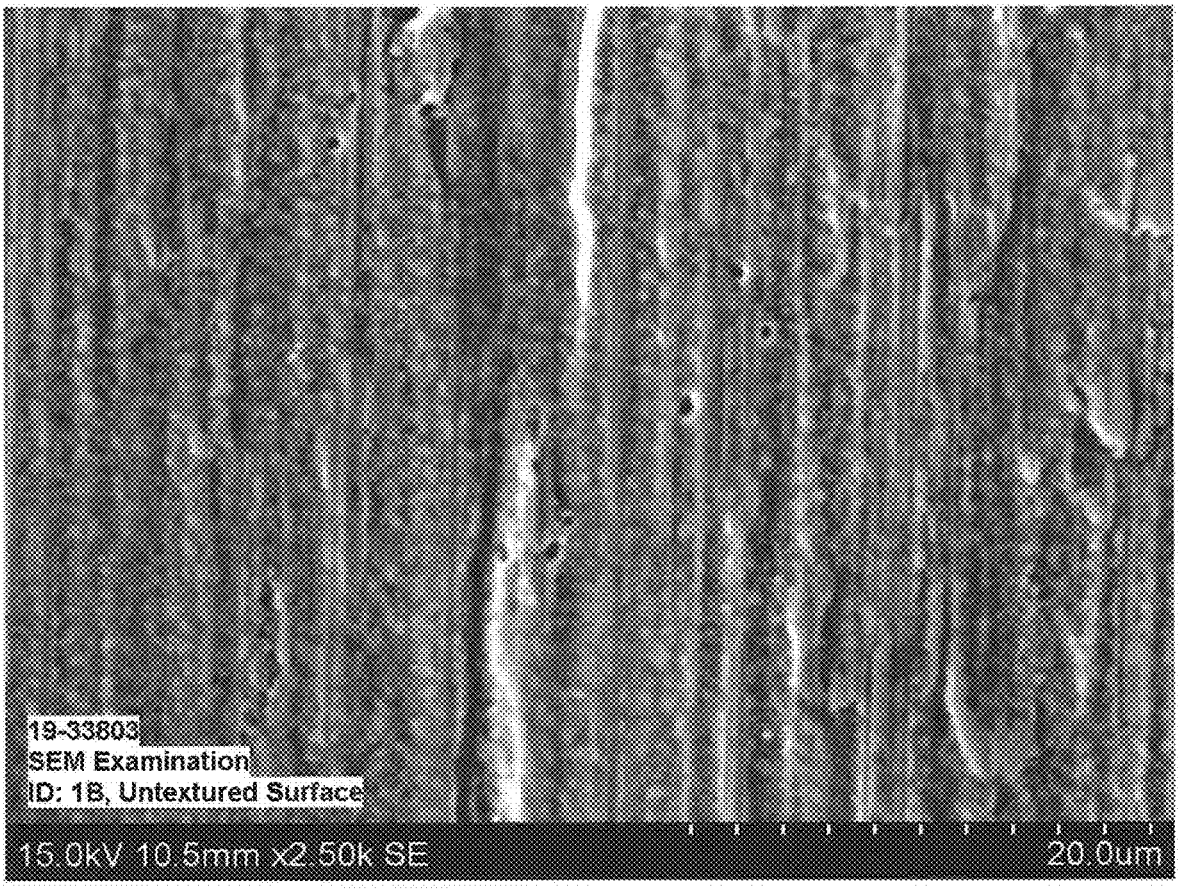

As noted, the overall benefit of a hydrophobic behavior in a condensing application is a significantly improved thermal performance. The heat transfer coefficient of the hydrophobic surface has been shown to be approximately double that of the film forming heat transfer surface, see "Microscopic Study of Dropwise Condensation" PhD Dissertation, University of Illinois, Urbana, Ill., 1961 authored by Welch, J. F., Westwater, J. W., hereby incorporated by reference in its entirety. Contact angles as low as 72° have been found to effectively increase heat transfer. Hydrophobicity is believed to be the result of having a microscopically textured surface that traps a gas under the liquid, as shown in FIG. 2. See, "Wettability of Porous Surfaces", Faraday Soc. 40 (1944) pp 546-551, authored by Cassie, A., Baxter, S., hereby incorporated by reference in its entirety.

As will be appreciated, improvement in heat transfer characteristics provides several specific benefits:

1. A heat exchanger having the desired thermal capacity can be approximately 50% of the size of a conventional heat exchanger having conventionally-textured tubing. This can result in significant reductions in both material and manufacturing costs.

2. Significant additional financial benefits can be achieved by decreasing the size of the entire system surrounding the exchanger. In a traditional power plant, the steam surface condenser is normally placed directly below the steam turbine and generator. For the turbine and generator to operate reliably, the installation requires very strong and solid foundations. Due to their height (some steam condensers can be over 50 feet tall), these structural requirements can be quite costly. If the condenser can be sized significantly smaller, by using reliable dropwise condensation, estimated savings from lowering the foundations can be more than $1,000,000 per foot. It is believed that these savings alone can significantly exceed the total cost of the condensing heat exchanger.

3. Overall operational savings, such as reduced pumping costs, would also be achieved.

As noted, the present invention contemplates formation of hydrophobic tubing which is more durable that hydrophobic coatings, and which is more cost-effective than chemical etching, metal deposition, and similar techniques. To manufacture a reliable hydrophobic surface, metals with high corrosion resistance to the environment, like high-performance stainless steel or titanium, are selected so that the textured, special surface does not gradually corrode away. In accordance with the present invention, one very fast, reliable method to produce a texture on a high-performance metal is to emboss the needed texture using cold-rolling of a coiled product, with textured rolls. High-performance metallic strips can be used for making the tubing textured during the cold-rolling process, with tubing manufactured utilizing continuous roll-forming into the tube shape, and welding of the edges.

Manufacturing techniques are selected to ensure that the surface texture is maintained throughout the manufacturing operation. Typical condenser tubing manufacturing utilizes a heat-treating operation that can potentially damage such surface texturing. However, it has been recognized that utilizing a very short, hydrogen anneal desirably minimizes damage to the textured surface. Such manufacturing can be cost-effective, and thus commercially feasible. Notably, the resulting product maintains the texture throughout the design life of a condenser.

Titanium, and titanium alloys, are commonly used in condensing heat exchangers. The methods for processing the strip, forming, and welding of the tubing, and the equipment used to make such tubing, are very similar to those employed in the present method, and is well known to those skilled in the art. Many tube manufacturers use substantially identical equipment for making titanium and titanium alloy tubing, stainless steel tubing, and nickel alloy tubing.

Preservation of the surface texture to provide the desired hydrophobicity is an important aspect of the present invention. During normal roll-formed tube manufacture, the rolls to shape the tube are made of a hard material, such as tool steel, to prevent wear, and maintain precise dimensional control. However, the tool steel used for such rolls is ordinarily much harder than the tube material, and as such, use of such tool steel roils in the present method can undesirably cause damage to the textured surface of the metal, thus resulting in portions of the tube being non-hydrophobic. This can result in significant degradation of the heat transfer performance. The present method contemplates use of forming rolls utilizing a soft exterior surface, or rolls formed entirely from softer material. Such rolls require sufficient structural strength to precisely form tubing in accordance with the present invention, but can be employed even though they exhibit a hardness value less than that of the tube material.

The present method contemplates heat treatment of the welded, textured heat exchanger tube. Heat treatment is desirable for several reasons. Heat treatment softens the tube, so that it has the ductility to be roll expanded into the tube sheet to seal the ends. The unannealed welds on some metals can have significantly lower corrosion resistance than the base metal. The unannealed weld can be significantly harder than the base metal, causing installation problems.

While many condenser tube specifications require heat treatment, it is not always specified how it is effected, and only require that the tubing meets a minimum temperature.

Moreover, many heat treatment systems use guides and rolls that can damage a textured surface. The present invention uses techniques which are specifically intended to prevent such damage.

Some steel alloys require very rapid quenching (removal of heat) after heat treatment to ensure that secondary phases, which cause degradation of corrosion resistance, do not form. For such alloys, it has been determined that only having a cool gas present does not provide the required quick quench characteristics.

As such, the present invention contemplates use of two specific quick quench techniques. By using water cooled shoes shaped to the contour of the tube, rapid heat removal is ensured. These shoes have a liner that is softer than the tube so that minimal damage occurs. This technique has been successfully used with some alloys, with these shoes desirably acting to support the tube so that it does not sag, or contact other components that would undesirably damage the tube surface.

An additional heat treatment technique, in accordance with the present invention, contemplates use of a forced protective gas, sent through jets. This gas is pumped through a heat exchanger to cool it for returning it back into the system. This type of system has been used on some large furnaces, but it is believed to be unique for its use on an annealer in-line with a welding mill.

Photomicrographs of steel surfaces show the surface texturing effect achieved in accordance with the present invention.

First, FIGS. 3A-3D are scanning electron microscope photomicrographs of an untextured steel surface, with magnifications varying from 50× to 2500×. The lack of distinct surface texturing is evident from these photomicrographs.

Figure 4A:
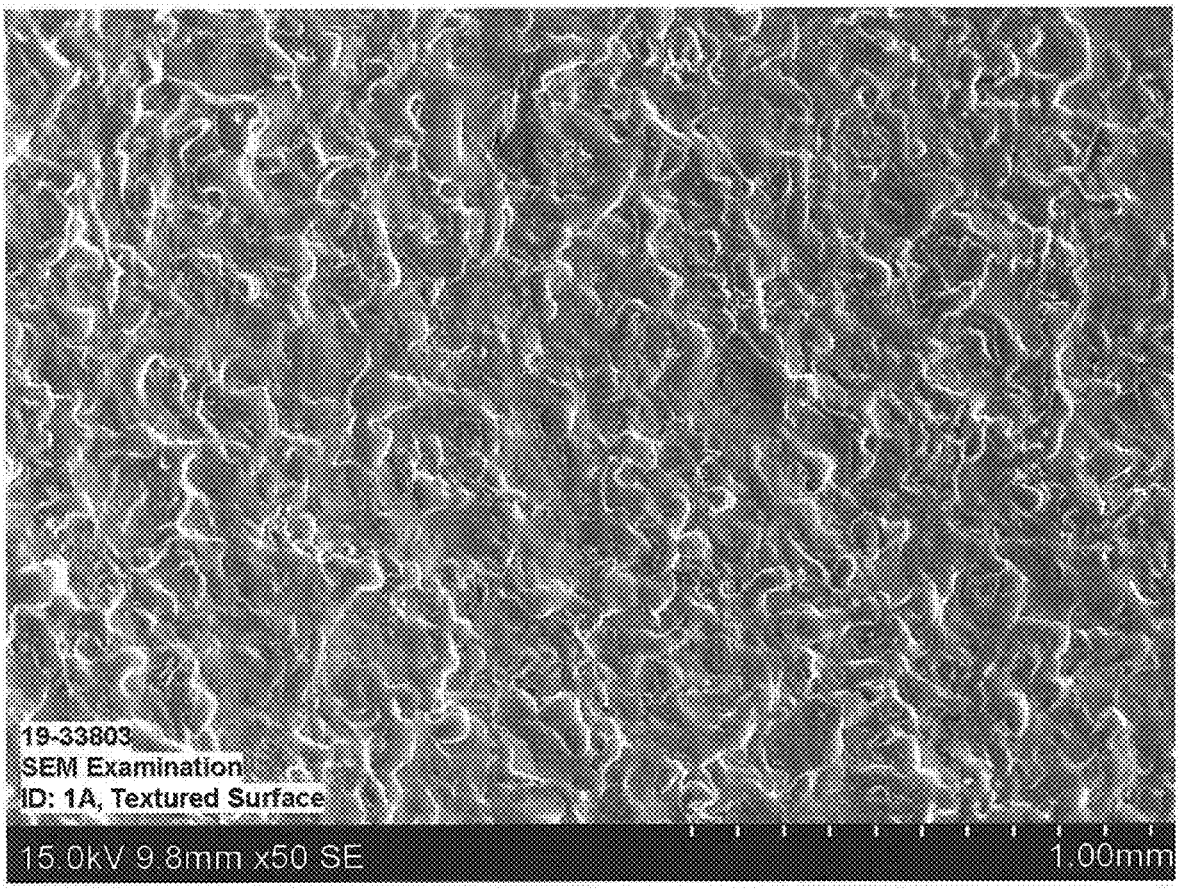
FIGS. 4A-4E are scanning electron microscope photomicrographs of a textured, steel surface, formed in accordance with the teachings of the present invention.
Figure 4B:
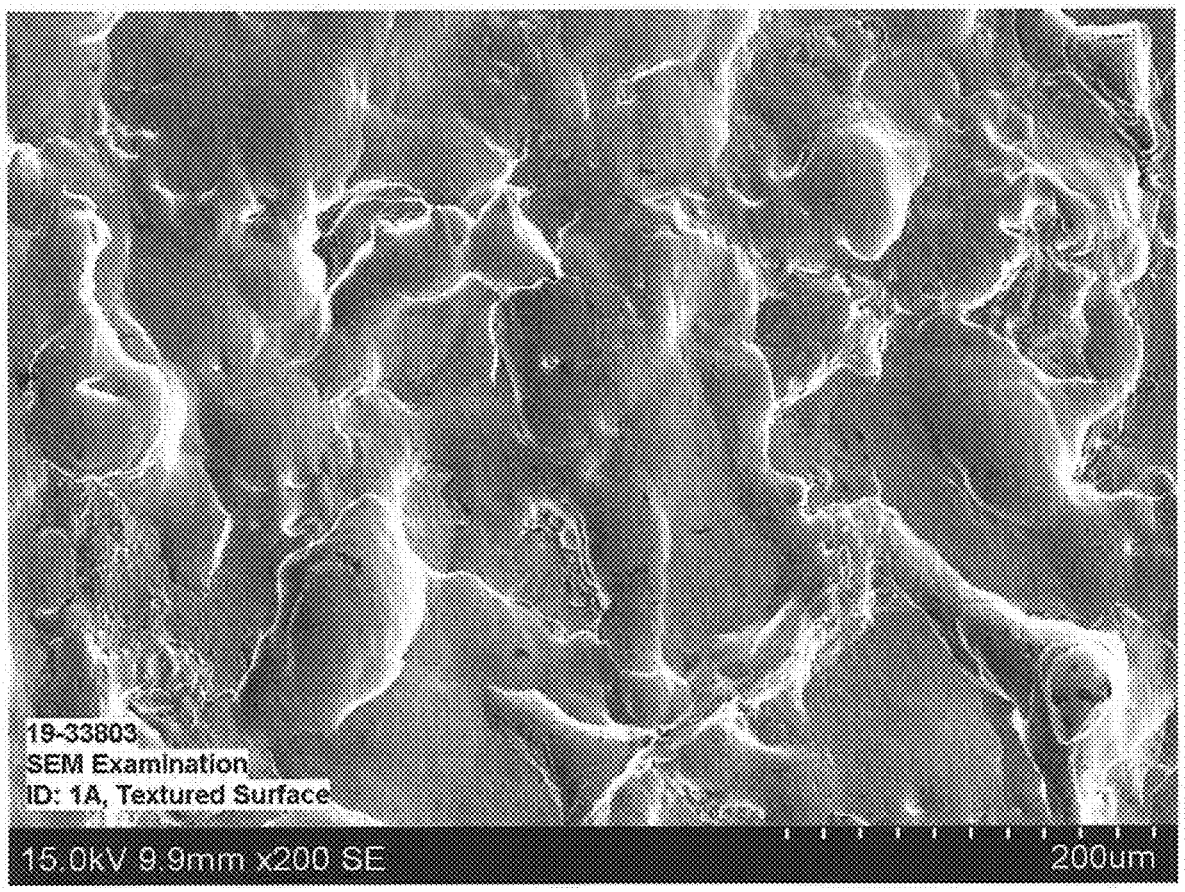
Figure 4C:
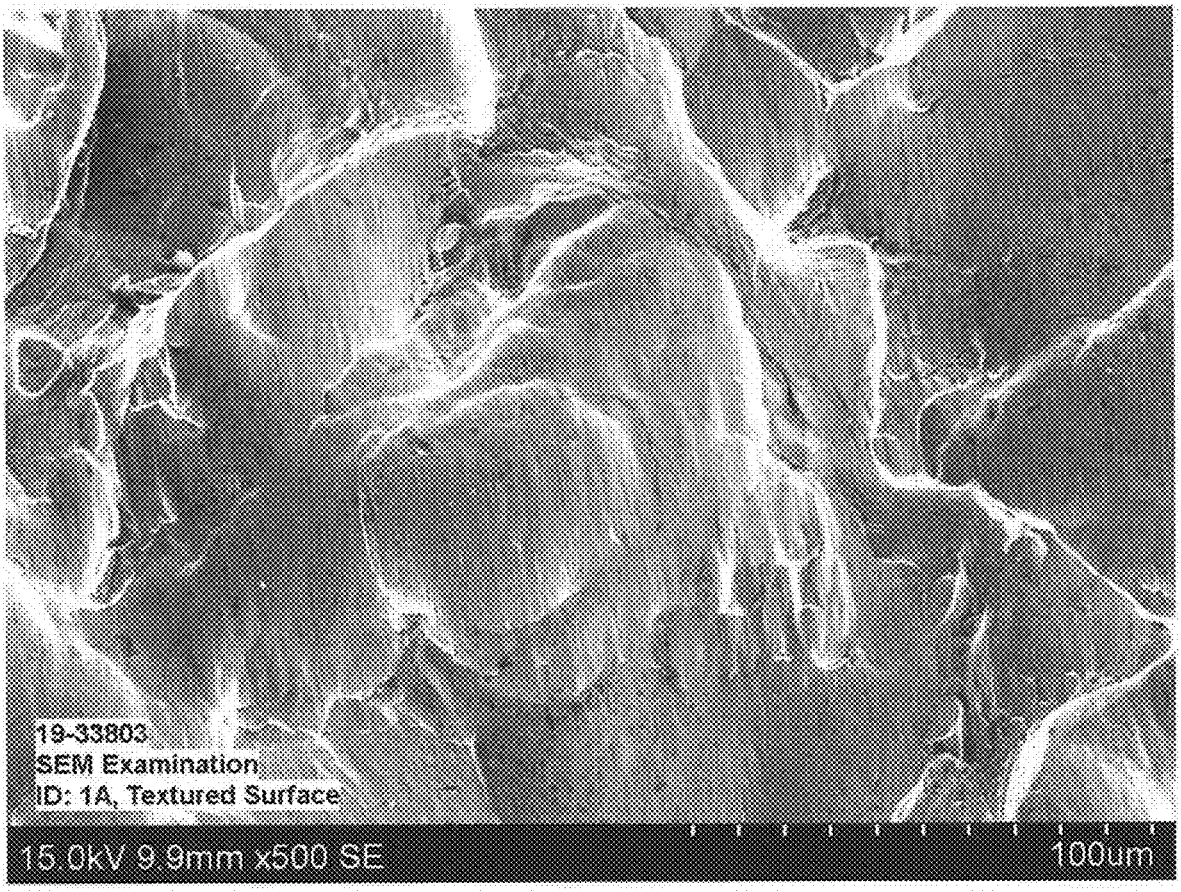
Figure 4D:
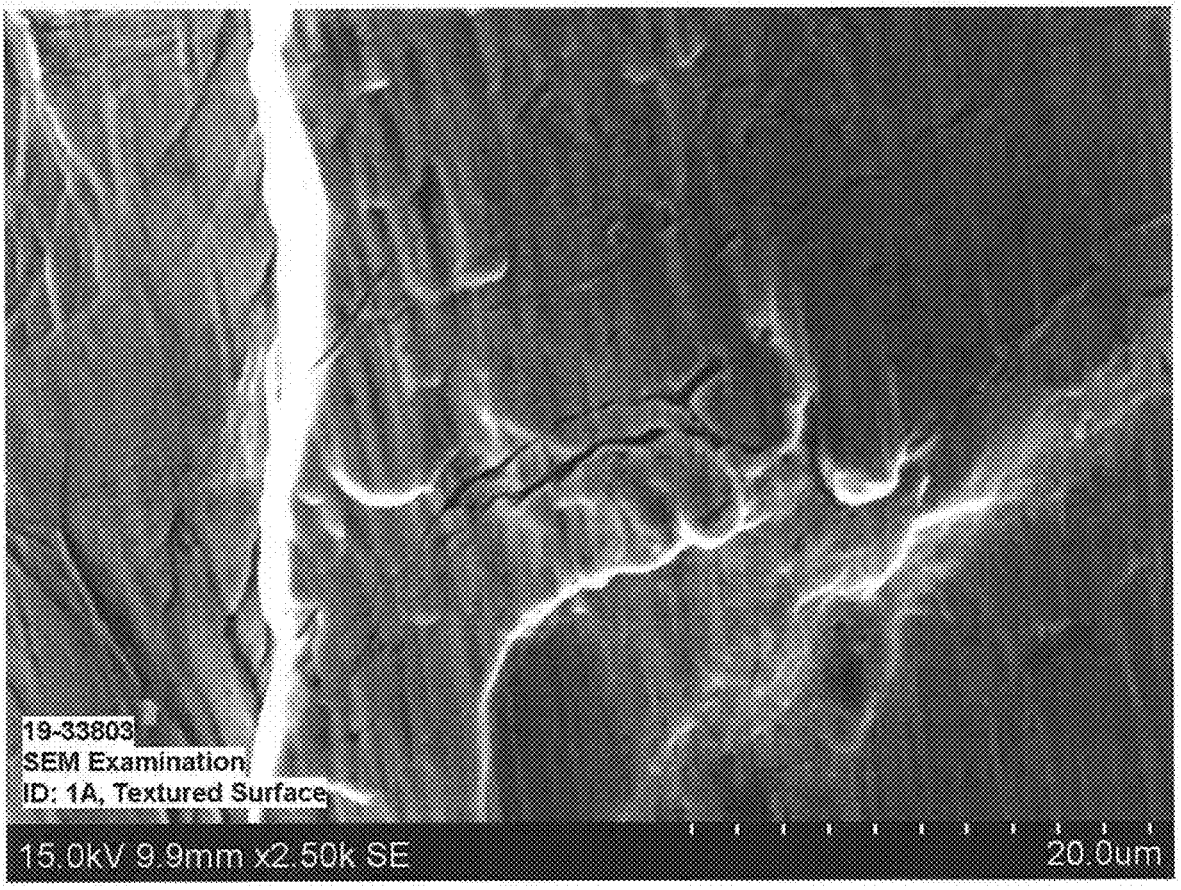
Figure 4E:
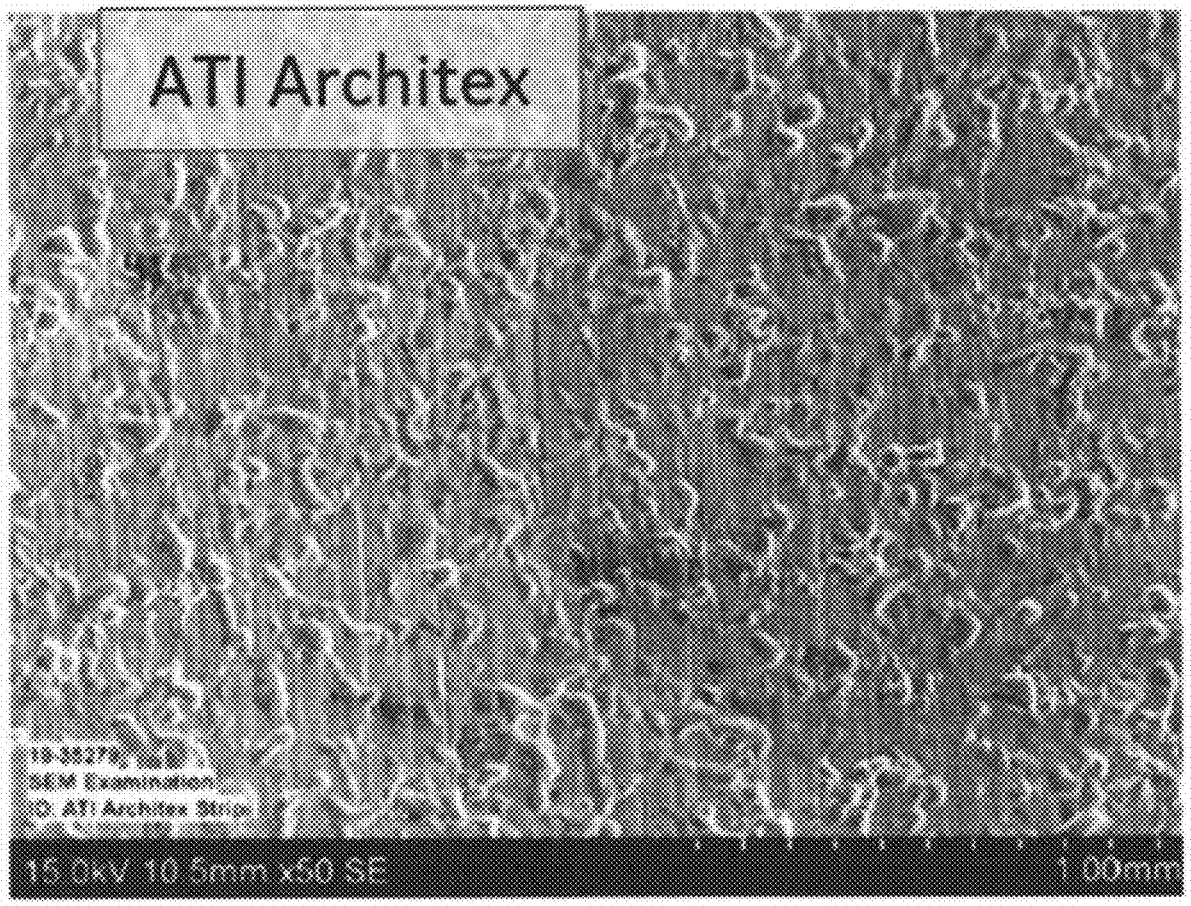

In significant distinction, FIGS. 4A-4D are scanning electron microscope photomicrographs of a textured steel surface, formed in accordance with the present invention, to exhibit hydrophobic characteristics. Again, these photomicrographs vary in magnification from 50× to 2500×, with the "bumps", of the textured surface being readily evident. FIG. 4E is a scanning electron microscope photomicrograph of a textured steel surface, shown at the same magnification as FIG. 4A, formed in accordance with the present invention, as supplied by another vendor.

A cost-effective manufacturing method to produce a hydrophobic tube with high long-term reliability is by use a continuous mechanical texturing process on a metal coil, that is later used to form a tube. This texture can be applied by either a mechanical polishing method, or mechanically embossing the strip surface in a rolling mill with a chemically or mechanically textured roll with the inverse pattern of the hydrophobic surface, or by a combination of both polish and emboss. Both methods are currently used for stainless steel architectural surfaces which provide desired visual appearance. Some of these surfaces have been found to be "self-cleaning" due to their hydrophobic nature.

Welded heat exchanger tubing is typically manufactured by roll forming coiled flat metal strip into a tubular shape and joining the edges together by welding to form a longitudinal seam. The operation is a continuous process with forming and welding taking place on the same equipment.

Strip can be supplied in coil form and slit to required width. The strip is then continuously formed using multiple rolls to shape it into a tube and then welded. The thickness of the tube wall is a function of the thickness of the strip used to make the tube. If a smaller diameter or thinner wall tube is desired, additional reduction operations may be required. Common welding processes include gas tungsten arc (GTAVV), also known as tungsten inert gas (TIG), plasma arc, electrical resistance, high frequency, and laser. Tubing produced under the scope of this document does not permit the use of filler metals. The weld is formed by melting or joining the strip edges.

Metal coils are commonly manufactured as coils between one and two meters wide, which is far wider than a metal strip needed to form into a tube. Each one of these coils may be as long as six thousand feet long, although three thousand to four thousand feet is more common. To manufacture a tube from a stainless-steel coil, the coil needs to be slit length-wise in widths necessary to form the desired tube outside diameter (OD). For example, to form a one-inch OD tube, the strand needs to be approximately three inches wide. The texturing process can be performed either before slitting or after slitting, depending upon the needs of the application. If only a smaller quantity is needed, the texturing may perform on only a few strands. However, some of the power plant steam surface condensers may contain more than 3,000,000 feet of tubing. In this case, it is more cost effective to texture an entire wide-band coil.

Figure 5:
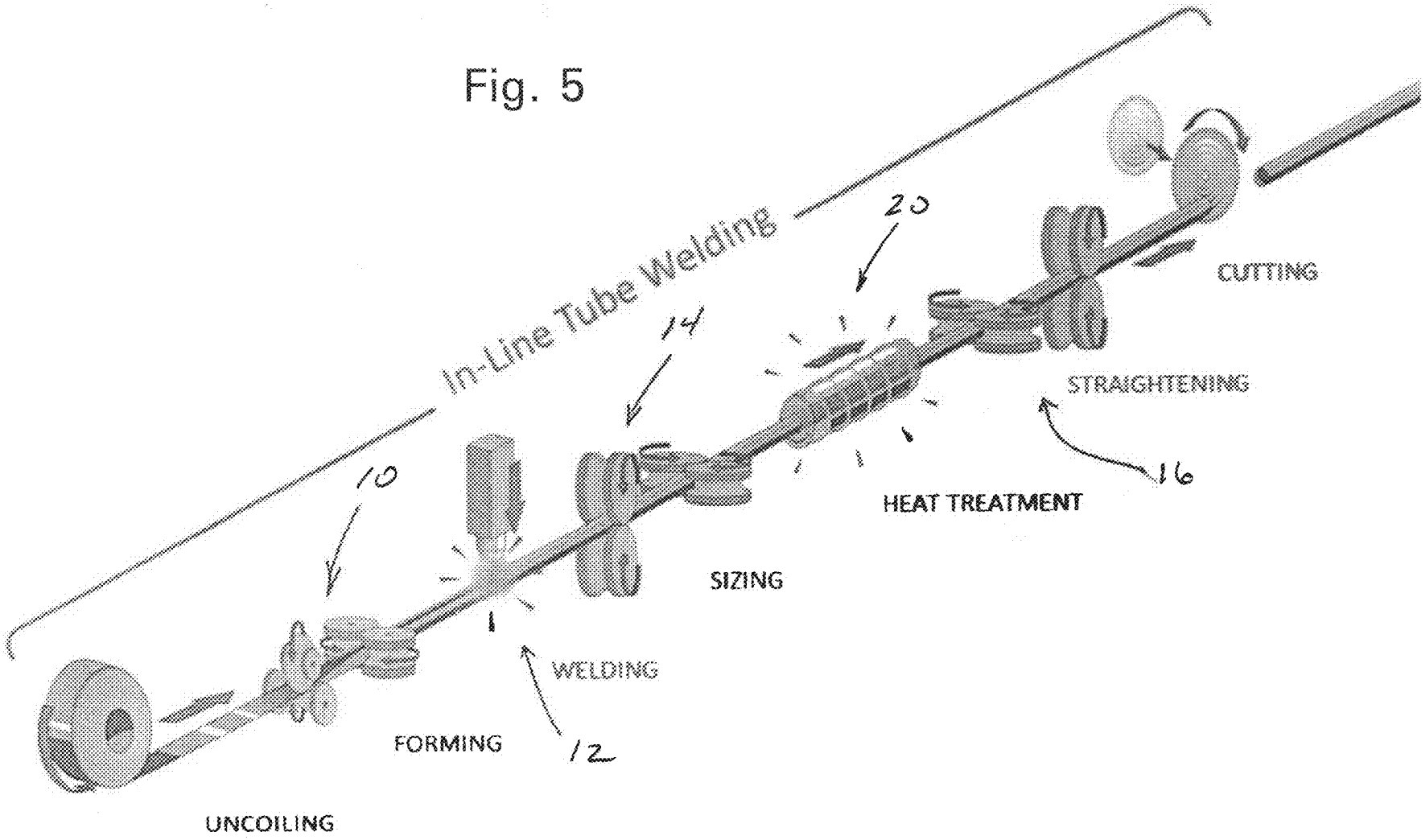
FIG. 5 is a diagrammatic view of a process of weld tube formation for practice of the present invention.

As illustrated diagrammatically in FIG. 5, the tubes are manufactured from the individual slit strands using a roll forming and welding process. The mill typically has three or more sections.

1. The first section is called the forming section, shown at 10. This section forms the strip into the tubular shape. The forming is performed using a series of horizontal and vertical rolls. Depending the material, OD, and wall needed for the tube, as few as six stands or more than a dozen may be utilized. In the final section or two, the rolls may have a "fin" down the centerline of the roll which guides the edges of the strip to the welding section of the mill.

2. The welding section of the mill, designated 12, centers and prepares the strip edges for the welding process and then supports the tube and weld until it solidifies with sufficient strength before exiting. The welding processes used for stainless steels, nickel alloys, and titanium include tungsten inert gas (TIG—also referred to as gas tungsten arc welding—GTAW), plasma welding, and laser welding. TIG is the most common method used today.

3. The final section is called the sizing and straighten section. As the tube exits the weld section may not meet the desired size and shape, the tube needs to go through a series of rolls that round the tube, shown at 14, that bring the tube to the appropriate size so that it can fit snugly in the holes of the tube supports used in the condenser, and be straightened enough, as shown at 16, so it can be installed. Much care needs to be done in this section as it is the one that can do the most damage to the hydrophobic surface.

All of the forming and sizing need to be done in a way that minimizes the change in strip's surface texture. This may be accomplished using specialized roll forming techniques on traditional rolls or by using special "soft-surface" rolls that give to the texture.

In a condensing application, a welded tube may be used in the as-welded condition or may be heat-treated, as shown at 20, after welding to improve both the corrosion resistance, and to increase ductility for the roll-sealing operation, to prevent leaking at the tube sheet which is the plate at the end of the tubes that prevents mixing of the condensing fluid on the outside of the tube with the cooling fluid on the tube ID. The heat-treating needs to be performed using a method that does not damage the hydrophobic surface.

Although heat-treating is commonly performed in air, it can also be performed in a protective gas. During a heat-treat in air, the surface oxidizes, damaging the hydrophobic surface. Therefore, both the heat-treating and the quenching method optimally need to be performed in a protective, and preferably a reducing, gas. A protective gas is one that is primarily made of argon or helium or a blend of both. A reducing gas is one that scavenges oxygen from the environment. Hydrogen is the common reducing gas. It can be used by itself or blended with argon, helium, or nitrogen and still retains its ability to scavenge oxygen.

While the present invention presently contemplates texturing tubing by welding cold-formed, textured strips for cost-effective practice, it has been determined that texturing can alternatively be imparted to a preformed tubular shape, such as by laser texturing, or texturing rolling, scoring, etc. of a welded or non-welded tube.

Embodiment of the Invention

For practice of the present invention, alloys that have been chosen are called SEA-CURE®, high-performance stainless steel with a UNS number of S44660 to do the trials, available from Plymouth Tube Co., of West Monroe, La. This alloy was chosen for two reasons:

1. It is a relatively inexpensive alloy that has high mechanical properties, high corrosion resistance, excellent fatigue resistance and has a 39-year track record in power plant steam surface condenser service.

2. Because of the properties noted above, this alloy it can be used in almost any cooling water including seawater, brackish water, recycled wastewater, lakes, rivers, and using cooling tower. As a smooth tube, more than 130,000,000 feet has been delivered for this application.

For practice of the invention, manufacture of sample tubes in a size of 1"×0.028" wall have been chosen, since this is the most common steam surface condenser tube size globally. At present, two suppliers produce a pattern on the strip used to practice the invention. These patterns have been used in architectural applications to provide certain visual effects on building walls and roofs.

A hydrophobic tube embodying the present invention was manufactured from a hydrophobic strip that was produced by current steel strip vendors, ATI, of Pittsburgh, Pa., (FIG. 4E) and Rigidized Metals, of Buffalo, N.Y. (FIGS. 4A-4D). These vendors utilize their own proprietary methods for imprinting texturing onto the steel strip. These vendors typically supply this strip as a building material for roofs to reduce the amount of water that will collect upon the roof. As shown in FIG. 4A, the sample exhibited a uniformly distributed, ridged surface topography; little directionality was observed. No evidence of machining or process-related marking (i.e. drawing or extrusion marks) was seen. The textured surface shows "scaly" areas of appearance. As shown in FIG. 4E, the sample showed uniformly distributed, ridged surface topography; some directionality was observed. Evidence of machining or process-related markings, likely present before texturization, was seen. The textured surface appears "bubbly".

For vendor Rigidized, a single slit coil of approximately 3.110" wide×0.028" thick coil was provided to them to texture as a single coil. For vendor ATI, a wide band coil of SEA-CURE approximately 36" wide, was provided, which was textured as the wide band and then slit into several coils of 3.110" wide strand coils. The patterns from both vendors have been found to be hydrophobic as they shed water while on buildings.

During development of the present invention, it was determined that by the use of this material with delicate roll forming techniques, it is possible to manufacture a hydrophobic tube from a hydrophobic strip. The present inventors utilized existing machinery for welded tube making, with some important modifications for maintaining the textured surface on the steel strip upon forming and welding into a hydrophobic steel tube.

Naturally, a steel strip will have its outer (lower surface as it feeds into the weld mill machine) surface stretched as it is roll formed into the outside diameter of the tube being formed. Given the usefulness of a hydrophobic surface on the outside of a steel tube used for thermodynamic condensing applications, a hydrophobic tube having the OD surface hydrophobic is necessary. The natural tendency for the surface to be stretched upon bending makes the formation of a hydrophobic tube from a hydrophobic strip very difficult to achieve.

Proper roll forming tooling must be set-up in series, with multiple stages of slight progressive forming of the strip into the shape of a tube. Using multiple arrangements of "roll forming stands" for these stages allows the slight progressive formation of the strip into a tube. It was determined that having no stage in the forming and sizing process too extreme, in comparison to the others, is helpful to reduce marring/stretching of the textured strip surface. Any acute, extreme stretching of the strip surface will eliminate the surface texturing impressions. The impressions in the strip are what render the strip hydrophobic. Keeping these impressions intact is what makes the formed steel tube hydrophobic. The less marring of the strip surface contributes directly to the hydrophobicity of the formed steel tube.

In current practice, the mill is configured with 13 forming stands: 8 vertical driven stands and 5 side passes. The first four vertical stands are commonly called "breakdown stands" and the next four vertical stands are commonly called "fin stands" (though the last stand is sometimes called a "finless stand"). Three sets of two weld rolls in are provided in the weld box. After the weld box, a driven vertical stand, the hammer forge (unused on the hydrophobic), another driven vertical stand, and a side pass are provided. After the forging section, a bright annealer and a quench system are provided. After the annealer system, a small stabilizing side pass is provided, followed by the sizing section, consisting of a two vertical driven stands, and two side passes. This mill is configured with one 15 hp motor driving all the stands.

A standard roll forming tube weld mill typically includes a final roll forming section that is used for achieving the finished tube size/tolerancing for a required customer application specification. Significant surface marring is experienced at this section of the tube weld mill. It has been determined that particular attention to delicate tube forming at this stage is important. Specifically, it was determined, through testing, that relaxed final size tolerancing, via loosening the tightness of contact between the sizing section forming rolls, desirably reduces the loss of the hydrophobic texture in the formed tube. Loosening the sizing section roll forming tooling can aid in keeping the desired hydrophobic texturing on the outside of the tube.

Notably, lubrication is preferably incorporated in the sizing section (as well as the forming section) rollers to reduce friction and marring of the tube as it passes through the sizing section rollers. Microscopic lubricant droplets are sprayed, utilizing air atomizing spray guns where air is mixed with the lubricant, to provide a fine mist of lubricant droplets onto the rollers where the tube is contacted. This lubrication reduces the marring effect from the rollers onto the formation of the hydrophobic tube. A spray nozzle that uses between 20-40 PSI at 1.4-2.1 CFM of air mixed with an oil emulsion, DuBois Pearl Z 3421D diluted 10:1, water-to-lubricant, that is gravity fed into the spray gun and sprayed through an orifice of 0.014" diameter, has been found to provide the optimal atomization of lubricant to be supplied onto the roll forming tooling. A distance about 6 inches from the spray tip to the roll forming tooling provides an optimal distance for the oil emulsion to atomize. Other settings can produce an atomized lubrication spray to help maintain the hydrophobic texturing, but the settings above have been found at present to be optimal for maintaining the texturing on the tube.

Tubing was produced in both un-heat treated and heat-treated conditions from strip textured by both vendors. During the heat-treat process, a continuous closed furnace was used in-line with the welding operation, and the heat-treating was performed between the welding and sizing operations. The heat-treating was done by inductive heating and the temperature was between 1600 and 1850° F. The temperature was controlled by an optical pyrometer placed next to a window directly behind the induction coil. As SEA-CURE requires a very quick quench to maintain its corrosion resistance, a forced 100% hydrogen gas jet was used right after the induction coil. Hydrogen was chosen as it has 10 times the thermal conductivity than either argon or nitrogen.

After the strip is formed into a tube and welded, a solution annealing process is used to homogenize the weld and heat affected zone into the base metal. The annealing process is completely enclosed in a controlled atmosphere in order to keep the material from oxidizing. Eliminating oxide formation onto the tube also keeps the hydrophobic texturing from being damaged, since the oxide could be compressed into the textured surface and would also need to be removed via polishing after exiting the weld mill process. This solution annealing process results in a uniform fine grain structure throughout the tube which enhances the performance of the tube. The present annealing process uses induction heating to bring the tube temperature between 1750-2000° F. for 15 seconds. When the tube exits the annealer it is quickly quenched by passing through enclosed copper shoes that cool the tube down to room temperature, 50-90° F. It has been observed that annealing can reduce the hydrophobicity of the tubing being formed.

All of the tubes made from strip from both vendors and both un-heat treated and heat treated conditions have been found to maintain much of the original texture.

Observation and comparison of textured tubing formed in accordance with the present invention, and non-textured tubing, showed markedly greater hydrophobicity of the textured tubing. The non-textured tube exhibited water retention and film formation, while the textured tube exhibited water-shedding. and little to no water retention.

Testing of textured and untextured flat panel was consistent with these observations. Water contact angles of flat panel strips were tested by growing drops to 1.0 microliters on the end of a blunt tip needle, which were then brought down and touched off the surface. Contact angle measurement were made with a Kruss Drop Shape Analysis System DSA100, with the following data collected:

| Drop # | Texturized Flat Panel | Un-Texturized Flat Panel |
|---|---|---|
| 1 | 101.2 | 80.3 |
| 2 | 100.8 | 81.2 |
| 3 | 100.3 | 80.4 |
| 4 | 100.9 | 81.1 |
| 5 | 100.6 | 80.4 |
| 6 | 100.6 | 81.1 |
| 7 | 101.2 | 80.4 |
| 8 | 100.4 | 80.6 |
| 9 | 100.6 | 80.5 |
| 10 | 100.9 | 80.5 |
| Average | 100.8 | 80.7 |
| Std. | 0.3 | 0.3 |

Contact angle are direct measures of wetting on a scale of 0 degrees (complete liquid wetting surface in pancake fashion) to 180 degrees (liquid completely balled up as a sphere on the surface.)

Also consistent with observations of textured and untextured tubes were measurements of water contact angles. Water contact angles were measured on the outside surfaces of the two 1" inch diameter pipes in eight different positions relative to the weld considered to be at 0°. Positions are 0°, 45°, 90°, 135°, 180°, 225°, 270°, 315°. There is also a trend that the weld position of each tube shows the lowest contact angle for that particular tube, and the positions adjacent to the weld (45° and 315° rotations) show contact angles that are somewhat lower than the rest of the tube as well. So those positions are slightly less hydrophobic on any given tube.

Standard ten-drop tests per position were used to explore any differences in position and between the samples with statistics. Drops were grown to 1.0 microliters on the end of a blunt tip needle and then brought down and touched off on the surface. Contact angle measurements were made with a Kruss Drop Shape Analysis System DSA100.

Contact angles are direct measures of wetting on a scale or 0° (complete liquid wetting surface in pancake fashion) to 180° (liquid completely balled up as a sphere on the surface).

Sample 1 - ATI Texture
Water Contact Angles

| Drop # | 0° Weld Position | 45° Rotation (degree) | 90° Rotation (degree) | 135° Rotation (degree) | 180° Rotation (degree) | 225° Rotation (degree) | 270° Rotation (degree) | 315° Rotation (degree) |
|---|---|---|---|---|---|---|---|---|
| 1 | 100.1 | 100.4 | 101.2 | 101.4 | 101.4 | 100.9 | 101.2 | 101.1 |
| 2 | 100.2 | 101.3 | 101.7 | 101.8 | 101.3 | 100.9 | 101.7 | 100.7 |
| 3 | 100.7 | 100.6 | 101.5 | 101.6 | 101.2 | 101.4 | 101.2 | 100.6 |
| 4 | 99.9 | 100.8 | 101.0 | 100.8 | 101.2 | 101.0 | 101.2 | 100.6 |

-continued

Sample 1 - ATI Texture
Water Contact Angles

| Drop # | 0° Weld Position | 45° Rotation (degree) | 90° Rotation (degree) | 135° Rotation (degree) | 180° Rotation (degree) | 225° Rotation (degree) | 270° Rotation (degree) | 315° Rotation (degree) |
|---|---|---|---|---|---|---|---|---|
| 5 | 100.4 | 100.7 | 101.1 | 101.4 | 101.3 | 100.9 | 101.8 | 100.8 |
| 6 | 100.5 | 101.1 | 100.8 | 100.8 | 101.2 | 101.0 | 100.9 | 100.6 |
| 7 | 100.3 | 101.2 | 100.8 | 101.4 | 101.2 | 100.8 | 101.7 | 100.8 |
| 8 | 100.7 | 101.2 | 101.3 | 101.3 | 101.2 | 101.2 | 100.8 | 100.9 |
| 9 | 99.9 | 100.6 | 101.4 | 101.0 | 100.9 | 100.9 | 101.5 | 101.2 |
| 10 | 100.4 | 101.3 | 100.9 | 101.1 | 101.7 | 101.2 | 100.9 | 101.1 |
| Average | 100.3 | 100.9 | 101.2 | 101.3 | 101.3 | 101.0 | 101.3 | 100.8 |
| Std. | 0.3 | 0.3 | 0.3 | 0.3 | 0.2 | 0.2 | 0.4 | 0.2 |

Sample 2 - Untextured
Water Contact Angles

| Drop # | 0° Weld Position | 45° Rotation (degree) | 90° Rotation (degree) | 135° Rotation (degree) | 180° Rotation (degree) | 225° Rotation (degree) | 270° Rotation (degree) | 315° Rotation (degree; |
|---|---|---|---|---|---|---|---|---|
| 1 | 73.1 | 73.2 | 72.8 | 73.1 | 72.5 | 72.9 | 73.2 | 73.2 |
| 2 | 72.6 | 72.8 | 72.6 | 72.5 | 72.6 | 73.0 | 73.2 | 73.2 |
| 3 | 73.1 | 73.0 | 72.3 | 72.8 | 73.2 | 73.1 | 72.5 | 72.6 |
| 4 | 72.6 | 72.9 | 73.1 | 72.9 | 72.8 | 72.6 | 72.7 | 73.2 |
| 5 | 72.6 | 73.1 | 72.5 | 72.4 | 72.5 | 73.3 | 72.7 | 73.1 |
| 6 | 72.7 | 73.2 | 73.1 | 73.2 | 73.2 | 72.8 | 72.3 | 73.1 |
| 7 | 72.8 | 72.7 | 72.3 | 73.0 | 72.4 | 72.4 | 73.1 | 72.7 |
| 8 | 72.3 | 72.9 | 72.7 | 73.0 | 72.5 | 72.9 | 73.2 | 72.7 |
| 9 | 73.0 | 72.9 | 73.1 | 73.3 | 72.4 | 72.5 | 73.1 | 72.4 |
| 10 | 72.5 | 73.2 | 72.6 | 72.6 | 73.1 | 72.4 | 73.3 | 72.4 |
| Average | 72.7 | 73.0 | 72.7 | 72.9 | 72.7 | 72.8 | 72.9 | 72.9 |
| Std | 0.3 | 0.2 | 0.3 | 0.3 | 0.3 | 0.3 | 0.3 | 0.3 |

The ATI textured sample was found to be hydrophobic, with water contact angles over 90° at each position tested. The Untextured sample was found to be far more hydrophilic, with contact angles of far less than 90° at each position tested.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

The invention claimed is:

1. A method of making a heat-exchanger tube, comprising the steps of:

providing a metallic strip;

cold-rolling the metallic strip to emboss a hydrophobic surface texture to form an embossed surface of the metallic strip;

roll-forming said metallic strip to a tubular shape, with said embossed surface of said metallic strip positioned on the exterior of the tubular shape; and welding the edges of the roll-formed strip to form a heat-exchanger tube.

2. The method of making a heat-exchanger tube in accordance with claim 1, wherein said cold-rolling step embosses said hydrophobic surface texture to exhibit a contact angle of at least about 75 degrees.

3. The method of making a heat-exchanger tube in accordance with claim 1, wherein said cold-rolling step embosses said hydrophobic surface texture to exhibit a contact angle of at least about 90 degrees.

4. The method of making a heat-exchanger tube in accordance with claim 1, including heat-treating said heat-exchanger tube to minimize degradation of said hydrophobic surface texture.

5. The method of making a heat-exchanger tube in accordance with claim 4, wherein said heat-treating step includes a specialized heat-treatment, including a method to minimize deformation of said hydrophobic surface texture.

6. The method of making a heat-exchanger tube in accordance with claim 4, wherein said heat-treating step comprises hydrogen annealing.

7. The method of making a heat-exchanger tube in accordance with claim 4, wherein said heat-treating step includes providing a gas blend that includes hydrogen.

8. The method of making a heat-exchanger tube in accordance with claim 4, wherein said heat-treating step includes providing an inert gas that minimizes oxidation of said hydrophobic surface texture.

9. The method of making a heat-exchanger tube in accordance with claim 4, wherein said heat-treating step includes employing a specialized quick quench system.

10. The method of making a heat-exchanger tube in accordance with claim 9, wherein said quick quench system employs forced gas flow.

11. The method of making a heat-exchanger tube in accordance with claim 9, wherein said quick quench system comprises a relatively soft, conductive shoe for removal of heat.

12. The method of making a heat-exchanger tube in accordance with claim 1, wherein said metallic strip comprises stainless steel.

13. The method of making a heat-exchanger tube in accordance with claim 1, wherein said metallic strip comprises one of titanium and titanium alloy.

14. The method of making a heat-exchanger tube in accordance with claim 1, wherein said roll-forming step includes providing forming rolls having sufficiently soft surfaces to form said tubular shape without significant deformation of said hydrophobic surface texture.

15. The method of making a heat-exchanger tube in accordance with claim 14, wherein said forming rolls entirely comprise soft material, or have a sufficiently soft surface layer.

16. The method of making a heat-exchanger tube in accordance with claim 1, wherein said roll-forming step includes applying lubricant to forming rollers to reduce friction and marring of the embossed surface of the heat-exchanger tube.

17. The method of making a heat-exchanger tube in accordance with claim 16, wherein said step of applying lubricant includes applying atomized lubricant to said forming rollers.

18. The method of making a heat-exchanger tube in accordance with claim 17, including applying said lubricant to said forming rollers at a distance of about 6 inches from forming surfaces of said forming rollers.

* * * * *